US007107687B2

(12) United States Patent
Okada

(10) Patent No.: US 7,107,687 B2
(45) Date of Patent: Sep. 19, 2006

(54) AUTO-LOCKING AND STEP-SLIDING TYPE CUTTER KNIFE

(75) Inventor: Shoji Okada, Osaka (JP)

(73) Assignee: Olfa Corporation, Osaka-fu (JP)

( * ) Notice: Subject to any disclaimer, the term of this patent is extended or adjusted under 35 U.S.C. 154(b) by 47 days.

(21) Appl. No.: 10/935,219

(22) Filed: Sep. 8, 2004

(65) Prior Publication Data

US 2006/0048392 A1 Mar. 9, 2006

(51) Int. Cl.
*B26B 1/08* (2006.01)

(52) U.S. Cl. ..... 30/162; 30/335

(58) Field of Classification Search ..... 30/151, 30/162, 320, 329, 335, 337, 339
See application file for complete search history.

(56) References Cited

U.S. PATENT DOCUMENTS 5,269,063 A * 12/1993 Okada ..... 30/162
6,226,873 B1 * 5/2001 Okumura ..... 30/162
6,745,474 B1 * 6/2004 Huang ..... 30/162

FOREIGN PATENT DOCUMENTS

JP 7-85752 9/1995
JP 2003-251084 9/2003

* cited by examiner

*Primary Examiner*—Hwei-Su C. Payer
(74) *Attorney, Agent, or Firm*—Crowell & Moring LLP

(57) ABSTRACT

A cutter knife with a blade extendable from and retractable into a cutter knife body by operating a slider. The cutter knife body has a plurality of engagement indentations formed alongside a slit. The slider has a spring member with an engagement head which is engageable with one of the engagement indentations. When an external force is directly applied to the blade in an advancing direction, the blade is inhibited from sliding out, because the distal side of the engagement head comes into contact with the distal end wall of the engagement indentation. When a predetermined external force is directly applied to the blade in a retracting direction, the blade can be withdrawn and held inside the cutter knife body by this external force, because an escapee is provided to the proximal end wall of each engagement indentation, or to the proximal side of the engagement head.

2 Claims, 12 Drawing Sheets

AUTO-LOCKING AND STEP-SLIDING TYPE CUTTER KNIFE

BACKGROUND OF THE INVENTION

1. Field of the Invention

The present invention relates to a step-sliding type cutter knife which holds a blade slidable in the cutter knife body, and which allows the blade to step-wise slide out or in by operating the slider. More particularly, the invention pertains to an auto-locking and step-sliding type cutter knife, in which the blade is locked so as not to slide when an external force directly acts on the blade, whereas the blade can slide out or in under the operation by the slider.

2. Description of Related Techniques

In the fields of the auto-locking and step-sliding type cutter knife, the applicant of the present invention has already developed a cutter knife, capable of withstanding a large load directly acting on the blade, with a simple structure, to which a patent has been granted (Japanese Patent No. 2,059,272).

FIG. 1 shows a perspective view of the cutter knife, and FIG. 2 shows an exploded perspective view thereof. FIG. 3 shows a plan view of the locking mechanism of this cutter knife, and FIG. 4 shows a longitudinal sectional view of the locking mechanism, taken along a longitudinal axis. The cutter knife has a metallic elongated sleeve member 2, and a blade 1 slidably held in the sleeve member 2. The blade 1 is slid out of or into the cutter knife body by operating the slider 3.

The sleeve member 2 is formed by bending a metal sheet to have a lipped-groove, wherein walls 22 are extended from both sides of a slit 21 into the groove. Each of the walls 22 has a plurality of engagement indentations 23 formed thereon at regular intervals along the advancing or retracting direction of the blade 1. Each of the engagement indentations 23 has a pair of end walls 24, which face to each other in the advancing or retracting direction of the blade 1. A grip 4 of a synthetic resin is fixed to the sleeve member 2 by insert molding or the like.

As seen in the exploded perspective view shown in FIG. 2, the slider 3 comprises a slider body 5, an operating member 6, and a spring member 7 disposed between the slider body 5 and the operating member 6.

The slider body 5 is connected to the blade 1, and slides inside the sleeve member 2. The slider body 5 comprises a base portion 51 and a holder portion 52. The base portion 51 is slidably held between the base wall 25 (see FIG. 4) and the walls 22 of the sleeve member 2, and the holder portion 52 is raised from the base portion 51 to hold the operating member 6. The base portion 51 has a projection 53 at its one end, and the projection 53 is inserted into a connection hole 12 formed at one end of the blade 1 to thereby connect the slider body 5 to the blade 1 within the sleeve member 2.

On the other hand, the operating member 6 is so coupled with the slider body 5 as to be relatively movable to the body 5 in parallel to the sliding direction of the body 5, and is exposed to outside through the slit 21 of the sleeve member 2. The operating member 6 comprises an operating plate 61 having a plurality of anti-slip grooves 62 formed at its upper face, and a locking part 63 which is protruded from the underside of the operating plate 61 and is inserted into the opening 57 of the holder portion of the slider body 5. Claws 64 with widths narrower than the width of the groove 58 of the slider body 5 are formed on both side faces of the locking part 63 and are fitted in the groove 58 and engaged therewith. Thus, the operating member 6 can slide in the advancing or retracting direction of the blade 1, when coupled with the slider body 5.

The spring member 7 has a convex engagement head 72 which is urged into one of the engagement indentations 23 to thereby lock the sliding of the blade 1. The spring member 7 is held between slider body 5 and the operating member 6 in such the blade-locking state. The spring member 7 is formed by bending one metal sheet, so that the flat spring portion 71 with a narrow width which extends along the advancing or retracting direction of the blade 1 is formed integrally with the convex engagement head 72 which has a width wider than that of the spring portion 71 and which is raised from the center of the spring portion 71. The engagement head 72 is composed of a pair of flat faces 73 facing to each other, and a curved face 74 bridging the flat faces.

The base portion 51 of the slider body 5 has a wider central opening 54 (FIG. 4) for receiving the engagement head 72 of the spring member 7, and narrow side openings 55 which are formed at both sides of the central opening 54. The total length of the openings 55 is slightly shorter than the whole length of the spring portion 71 of the spring member 7. Further, a slit 56 communicating with the openings 55 is formed between the holder portion 52 and the base portion 51. The holder portion 52 has an opening 57 at its center, and grooves 58 at its both sides, which communicate with the opening 57.

A V-shaped sloped face 65 is formed on the lower end of the locking part 63 of the operating member 6. This sloped face 65 is in contact with the curved face 74 of the engagement head 72, when the spring member 7 is inserted into the slit 56 of the slider body 5 and coupled with the slider body 5 with its spring portion 71 held substantially flat without any bending.

When the operating member 6 of the slider is operated to slide the blade 1, the operating member 6 is moved relative to the slider body 5 so that the engagement head 72 of the spring member is pushed downward by the sloped face 65 of the operating member 6. As a result, the engagement head 72 is put outside the engagement indentation 23 to unlock the blade. On the other hand, when the engagement head 72 of the spring member is moved to another adjacent engagement indentation, the engagement head 72 is automatically pushed up into this another adjacent engagement indentation by the urging force of the spring member to thereby relock the sliding of the blade (auto-locking).

In the cutter knife constructed as above, the blade can be slid out of or into the cutter knife body by operating the slider. On the other hand, when an external force is directly applied on the blade, the sliding of the blade is inhibited by the action of the locking mechanism. Thus, such a disadvantage can be prevented that the blade is undesirably slid by an external force which acts on the blade from a subject being cut, during the cutting operation.

However, in some situations, the above auto-locking type cutter knife would be rather inconvenience to skilled workers. In many cases, after a cutting operation, the skilled workers push the blades against the hard surfaces of metal plates or the like, to thereby retract the blade inside the cutter knives. However, with the cutter knife constructed as above, even if the blade is pushed against the hard surface, the blade can not be retracted because of the auto-locking mechanism. Therefore, it is needed to operate the slider for retracting the blade inside the cutter knife body. The skilled workers feel this operation troublesome.

SUMMARY OF THE INVENTION

Therefore, an object of the present invention is to provide an auto-locking type cutter knife, in which when an external force is directly applied to the blade in the advancing direction of the blade the auto-locking mechanism can operate, but when an external force is directly applied to the blade in the retracting direction of the blade the blade can be retracted by the external force.

The cutter knife of the present invention is provided by improving the foregoing conventional auto-locking type cutter knife. In the cutter knife of the present invention, when an external force is directly applied to the blade in the advancing direction, the distal end wall of the engagement indentation contacts with the distal side of the engagement head of the spring member, to thereby inhibit the blade from sliding out. The feature of the present inventions resides in that, an clearance (escape) is provided to the proximal end wall of the engagement indentation or to the proximal side of the engagement head of the spring member, so that when a predetermined external force is directly applied to the blade in the retracting direction, the blade can be retracted by the external force into the cutter knife body. In the specification, the wording "distal" means the side of the tip end of the cutter knife seen from the user holding the cutter knife, and the wording "proximal" means the opposite side to the "distal", i.e. the nearer side to the user holding the cutter knife.

In the cutter knife of the present invention constructed as above, when an external force is directly applied to the blade in the retracting direction of the blade, the auto-locking mechanism does not operate due to the clearance (escape) provided to the proximal end wall of the engagement indentation or to the proximal side of the engagement head of the spring member. Accordingly, the blade can be retracted into cutter knife body by this external force applied in the retracting direction.

On the other hand, when an external force is applied to the blade in the advancing direction of the blade, the distal end wall of the engagement indentation is engaged with the distal side of the engagement head of the spring member, so that the auto-locking mechanism operates, like in the conventional auto-locking type cutter knife. Accordingly, the blade is prevented from being undesirably slid out of the cutter knife body, during the cutting operation by a user.

BRIEF DESCRIPTION OF THE DRAWINGS

The other objects and features of the present invention will be understood clearly by the following description of preferred embodiments in conjunction with the accompanying drawings.

DETAILED DESCRIPTION OF THE INVENTION

Figure 1:
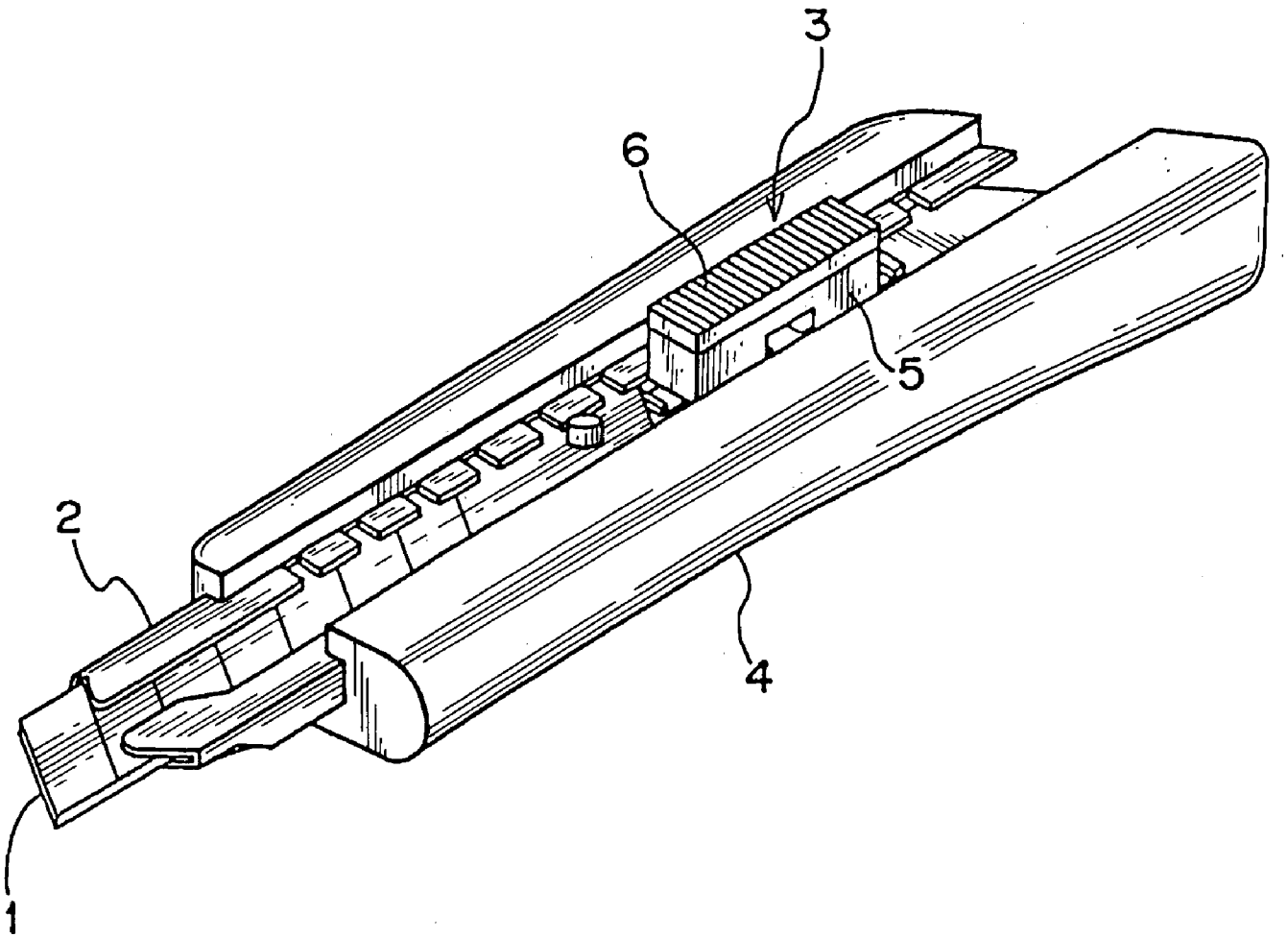
Fig.1 PRIOR ART
FIG. 1 is a perspective view of a conventional cutter knife.
Figure 2:
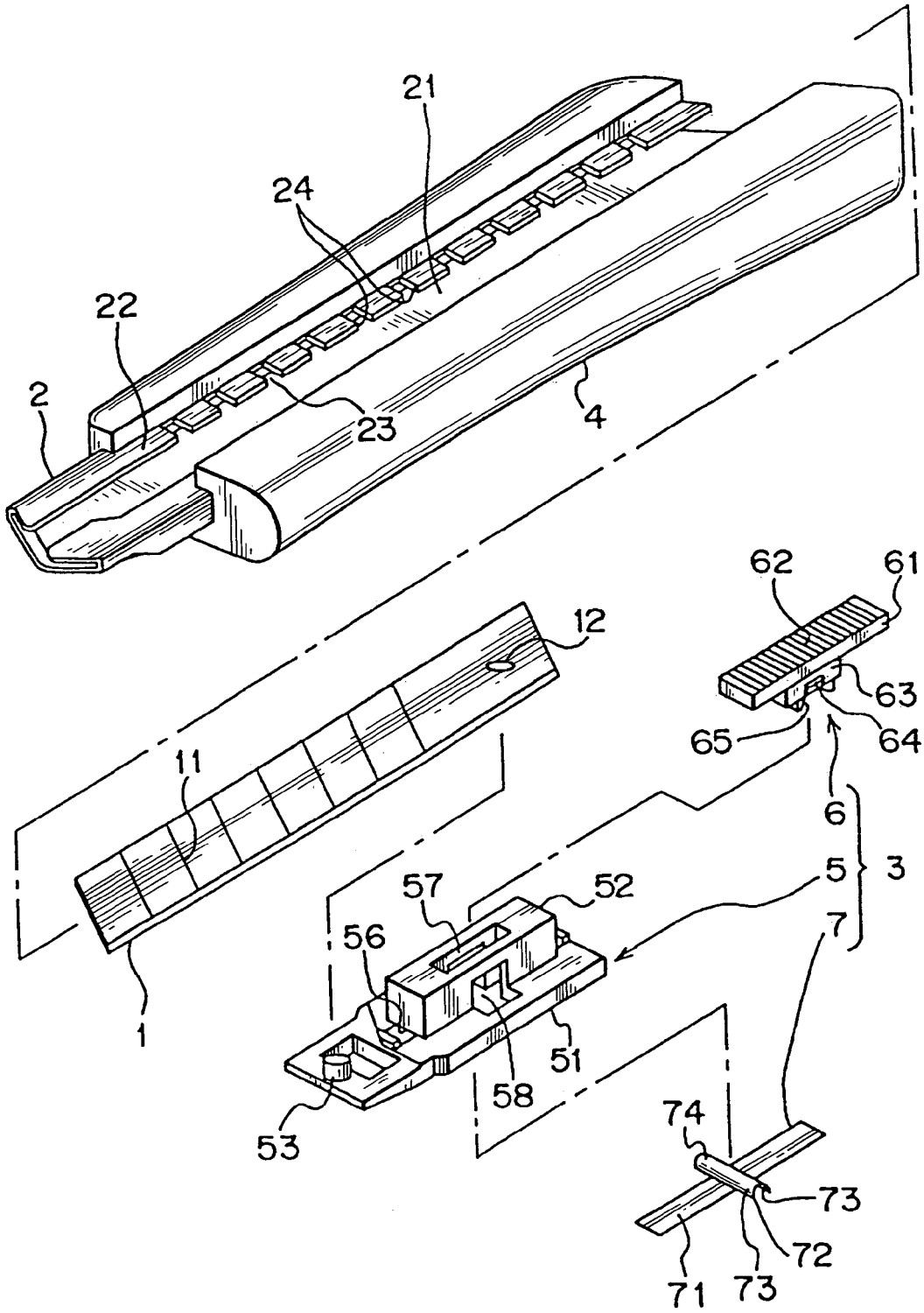
Fig.2 PRIOR ART
FIG. 2 is an exploded perspective view of the cutter knife shown in FIG. 1.
Figure 3:
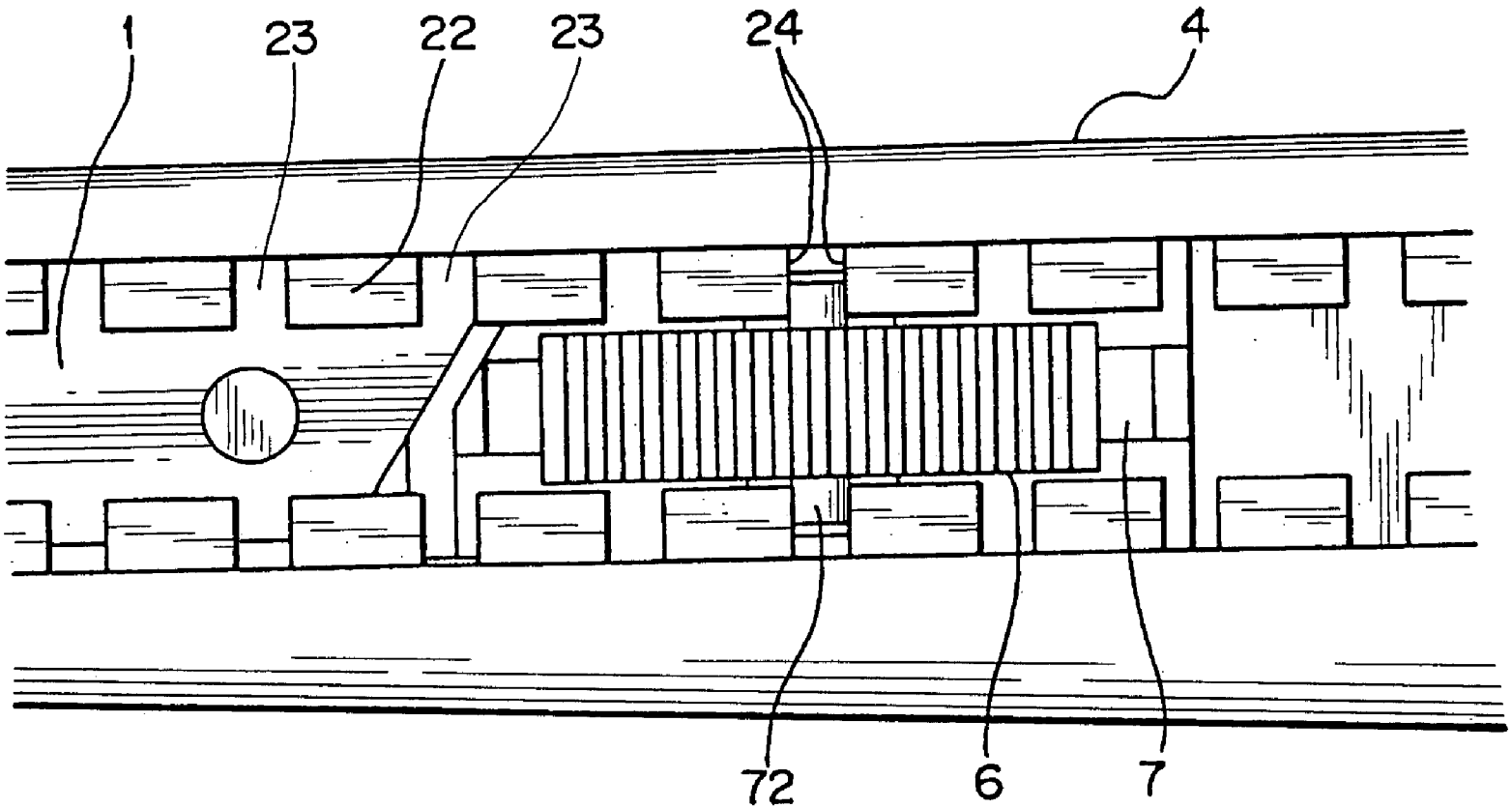
Fig.3 PRIOR ART
FIG. 3 is a plan view of the locking mechanism of the cutter knife shown in FIG. 1.
Figure 4:
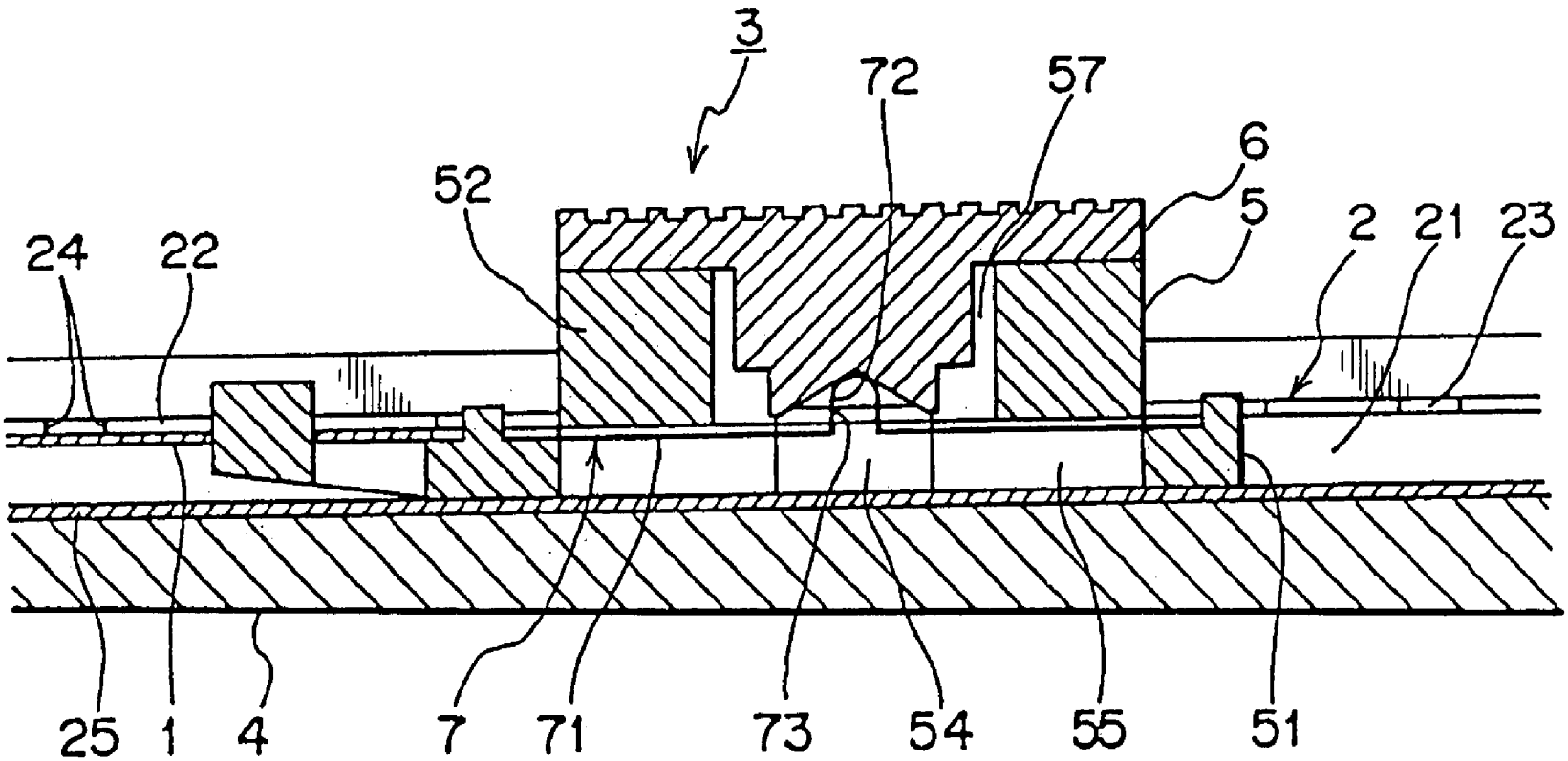
Fig.4 PRIOR ART
FIG. 4 is a longitudinal sectional view of the locking mechanism shown in FIG. 3, taken along a longitudinal axis.
Figure 5:
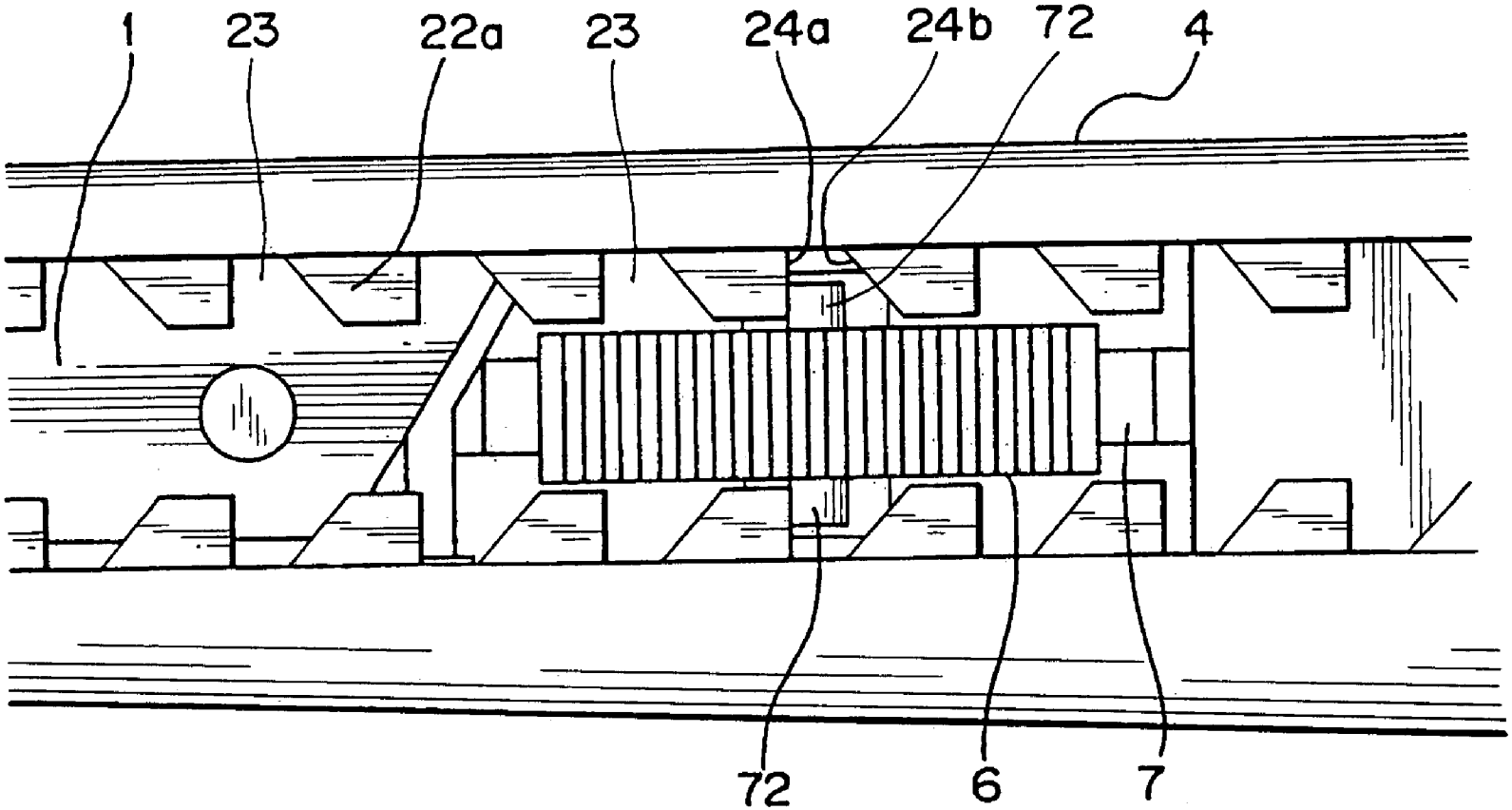
FIG. 5 is a plan view of the locking mechanism of a cutter knife according to an embodiment of the present invention.

FIG. 5, corresponding to FIG. 3, shows the locking mechanism of a cutter knife according to an embodiment of the present invention. The structure of this cutter knife is substantially the same as that of the conventional cutter knife shown in FIGS. 1 to 4, except for the configurations of the side walls of the engagement indentations. Therefore, the parts which are different from the conventional cutter knife will be only described.

In the conventional cutter knife shown in FIG. 3, the side walls 24 at both of the distal end and the proximal end of the engagement indentation 23 extend in right angle to the sliding direction of the slider. To the contrary, in the cutter knife of the present invention, the side wall at the proximal end (i.e., the side nearer to a user) of the engagement indentation 23 is inclined to form a sloped wall 24*b* to thereby provide an escape in the engagement indentation. Thanks to this escape, the engagement head 72 of the spring member 7 is put outside the engagement indentation 23 by the resilience of the spring member 7, when the engagement head 72 of the spring member 7 comes into contact with the sloped face 24*b*, under an external force applied to the blade 1 in the retracting direction. In the embodiment of FIG. 5, the engagement head 72 of the spring member is moved to the opposite side in the direction normally to the drawing paper. Therefore, the auto-locking mechanism does not operate, so that the blade 1 can be retracted into the cutter knife body by the external force.

What degree of the external force can slide the blade 1 in the retracting direction depends on the inclining angle of the sloped wall 24*b* and the resilience of the spring member 7.

The distal end wall 24*a* (i.e. the side of the tip end of the cutter knife) of the engagement indentation 23 extends in right angle to the sliding direction of the slider, like in the conventional cutter knife. Accordingly, when an external force is applied to the blade 1 in the advancing direction, the engagement head 72 of the spring member 7 comes into contact with the distal end wall 24*a* of the engagement indentation to thereby lock the sliding of the blade 1.

The structure of the slider in the cutter knife shown in FIG. 5 is the same as that of the slider in the conventional cutter knife shown in FIGS. 1 to 4. But, in the present invention, the structure of the slider is not limited to such one. The present invention is applicable to any of cutter knives, in so far as the cutter knife is provided with a slider for sliding a blade inside the cutter knife body, wherein an engagement head (convex portion) is projected from the slider and can be elastically pulled in, and the engagement head is to be engaged with one of plural engagement indentations formed along the lengthwise direction of the cutter knife body, to thereby lock the sliding of the blade.

The feature of the present invention resides in that, in such the cutter knife, an escape is provided to the proximal end wall of the engagement indentation, or to the proximal side of the engagement head, so that when an external force of a predetermined degree is directly applied to the blade in the retracting direction, the blade can be slid into the cutter knife body.

Therefore, the present invention is applicable to a variety of cutter knives having different structures of its slider. Hereinafter, some of other structures of sliders to which the present invention is applicable will be described. Note that these are intended for the illustrative purpose only.

Figure 6:
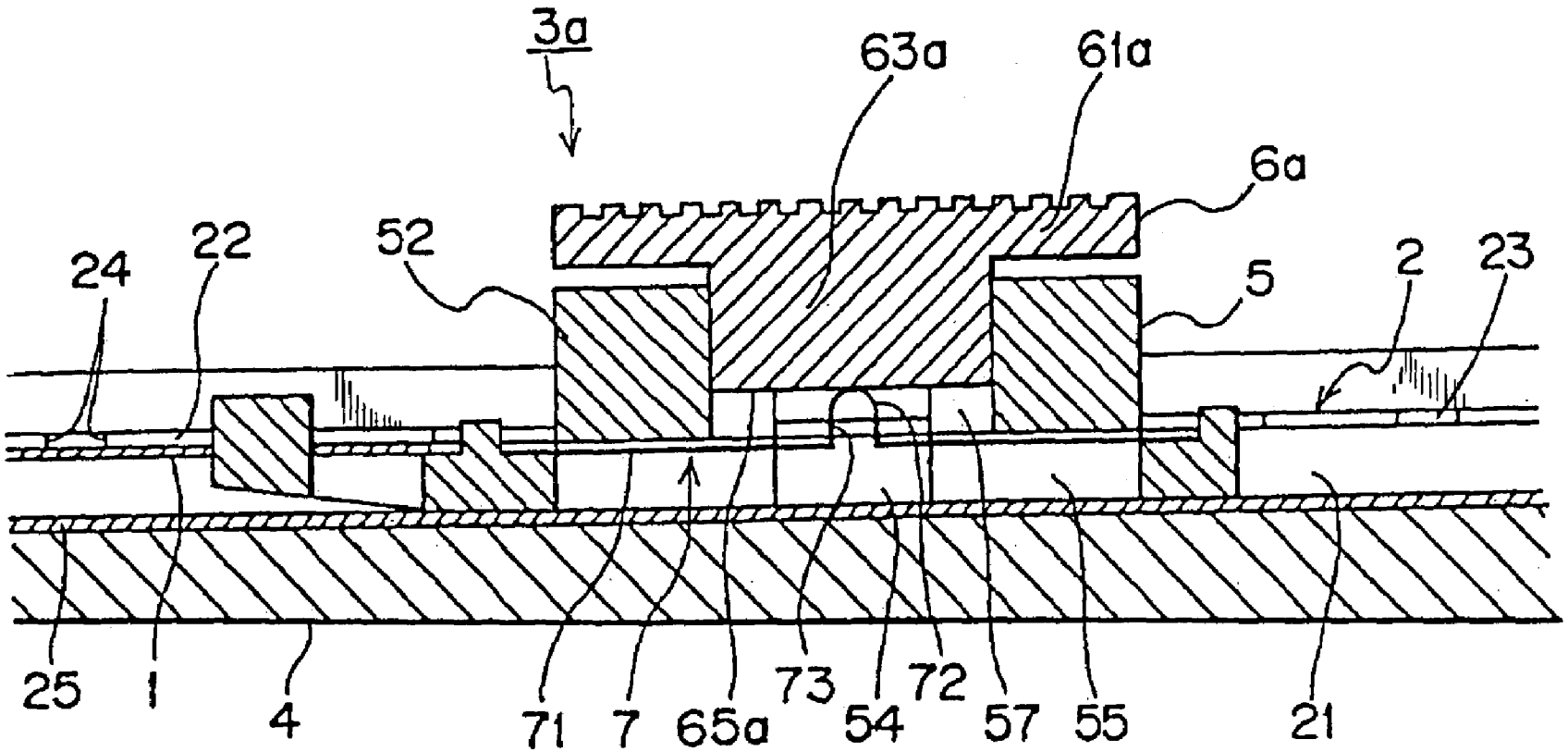
FIG. 6 is a sectional view of another locking mechanism to which the present invention is applied.

In the slider 3*a* of a cutter knife shown in FIG. 6, the shifting direction of the operating member 6*a* relative to the slider body 5 is set at 90° to the surface of the blade 1. In this embodiment, the locking part 63*a* is sized, such that it substantially contacts the interior wall surface of the opening 57 of the slider body 5, and is movable up and down. The locking part 63*a* has a flat press face 65*a* at its lower end, which contacts the engagement head 72 of the spring member 7 lying in straight without any bending. A space is provided between the holder portion 52 and the operating member 61*a*, so that the engagement head 72 of the spring member can be pushed down to a position at which the flat face 73 of the engagement head 72 is disengaged from the wall 24 of the engagement indentation 23.

Thus, pushing down the operating member 61*a* of the slider 3*a* makes the engagement head 72 disengaged from the engagement indentation 23, to unlock the blade.

Figure 7:
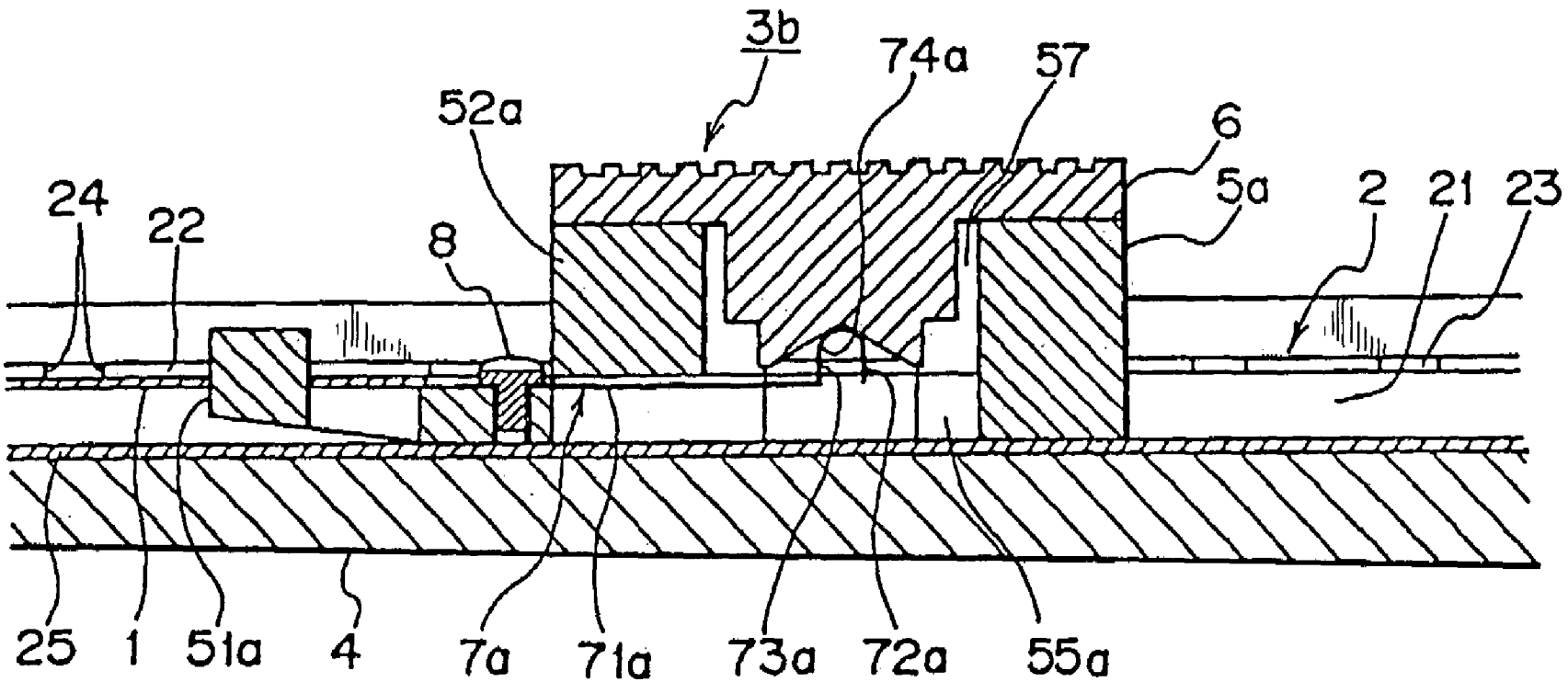
FIG. 7 is a sectional view of still other locking mechanism to which the present invention is applied.

FIG. 7 shows a slider 3*b* having another structure. In this embodiment, the slider 3*b* is so constructed that an engagement head 72*a* is located at one end of the spring portion 71*a*, and the other end of the spring portion 71*a* is fixed to the slider body 5 with a screw 8. Since this manner for fixing the spring member 7*a* is different from that in the former embodiment, the configuration and so on of the base portion 51*a* and the opening 55*a* of the slider are accordingly made different.

Figure 8:
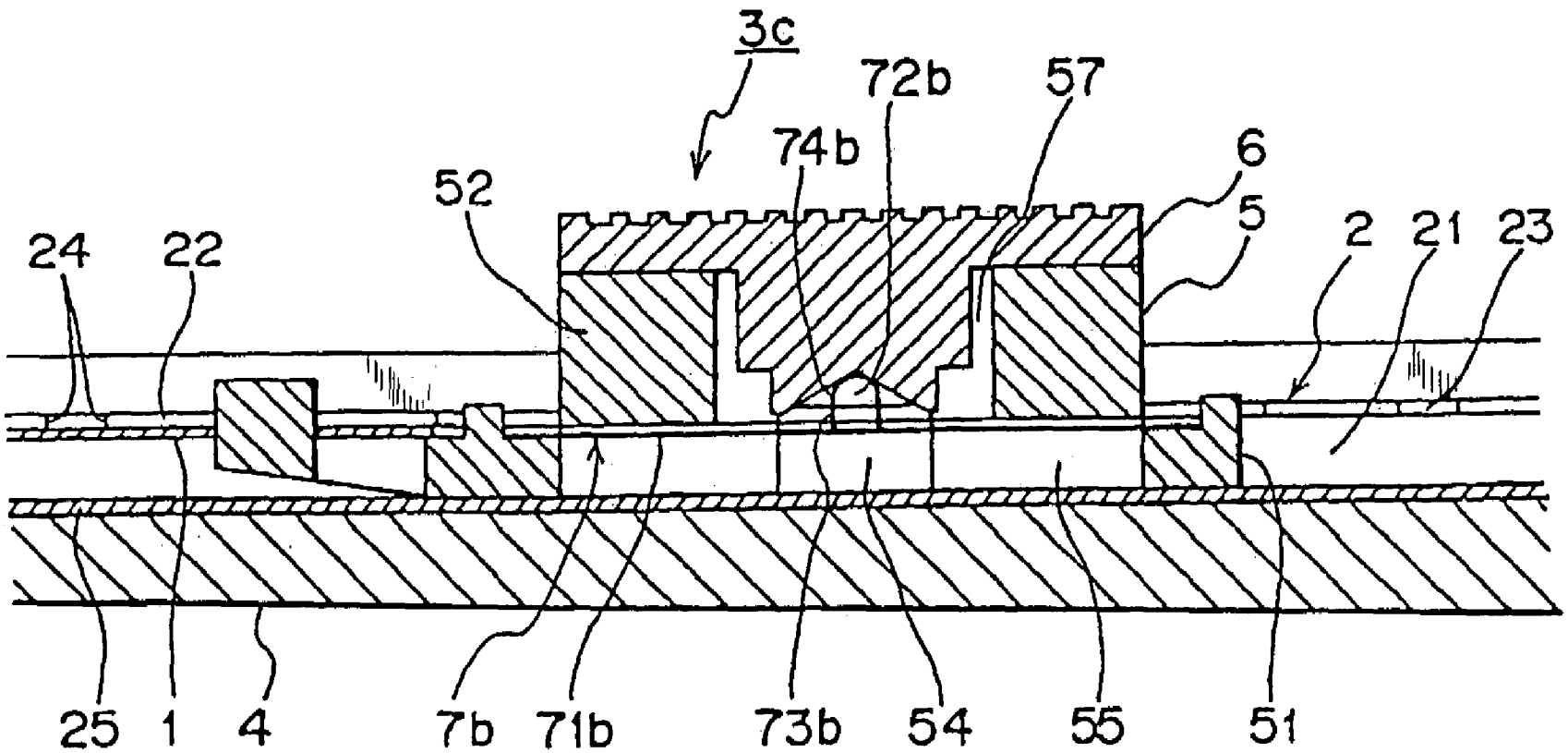
FIG. 8 is a sectional view of a further locking mechanism to which the present invention is applied.

FIG. 8 shows a slider 3*c* having still other structure. In this embodiment, a spring portion 71*b* and an engagement head 72*b* of the spring member 7*b* are separately formed. With such the construction, for example, since the engagement head 72*b* can be formed from a synthetic resin of a smaller friction coefficient, the slider can be operated more smoothly. In any of the former embodiments, since the spring members 7, 7*a* are formed by bending one metallic flat spring, the spring members are very easily produced by stamping. It is advantageous, because the cost for mass production of such the spring members can be lowered. Even in the embodiments wherein the spring members 7, 7*a* are formed by bending one sheet of metal spring, surface coating with a resin on the engagement head 72, 72*a* would make it possible to smoothly operate the slider 3, 3*a*, and 3*b*.

Figure 9:
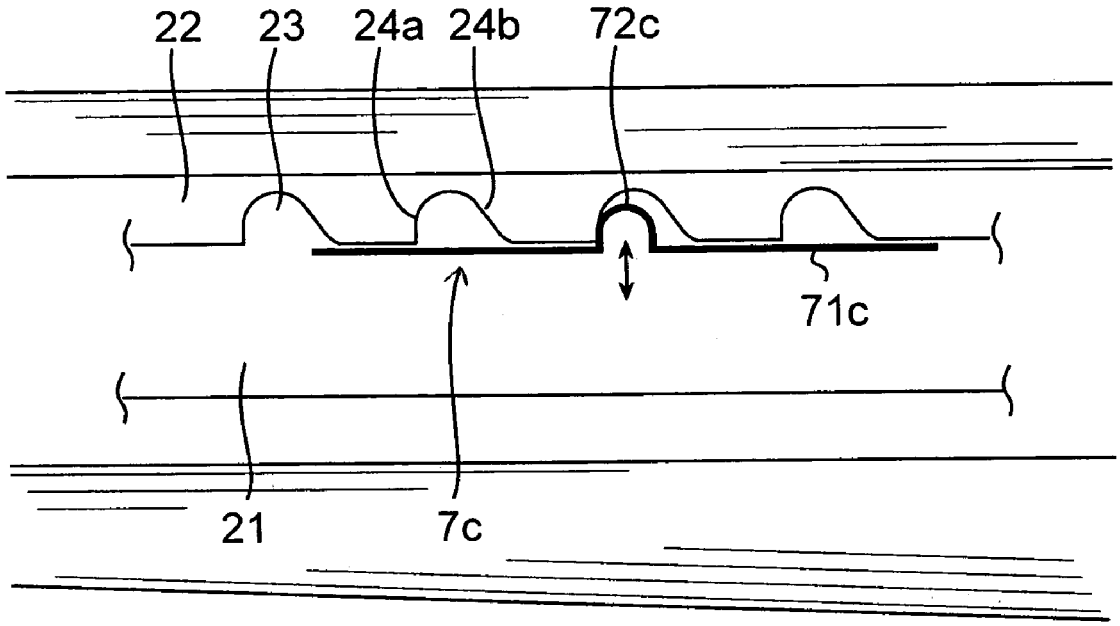
FIG. 9 is a plan view of engagement indentations with other configuration.

A further structure of the slider is described with reference to FIG. 9. In FIG. 9, there is only shown the engagement condition between an engagement indentation 23 and a spring member 7*c*. As is shown, in this embodiment, the spring member 7*c* is arranged in a plane substantially perpendicular to that of the blade, so that the engagement head 72*c* of the spring member 7*c* can be engaged with and disengaged from the engagement indentation 23 in the widthwise direction of the slit 21. Accordingly, the spring member 7*c* is held upright to the base portion of the slider body (not shown). Note that, in the embodiment in FIG. 9, there is no need to form engagement indentations on the wall at the lower side of the slit 21.

The engagement head 72*c* of the spring member is moved up and down in the arrow direction shown in FIG. 9 to thereby enter or exit the engagement indentations 23. Therefore, the operating member of the slider is held by the slider body so that the operating member can be shifted relative to the slider body in the direction of this arrow. Otherwise, while the operating member is held by the slider body so that the operating member can be shifted relative to the slider body in the advancing or retracting direction of the blade or in a direction vertical to the plane of the blade, such the operating direction is converted by a sloped face as is shown in FIG. 4, which is provided to the operating member. As a result, the blade of the cutter knife can be slid out of or into the cutter knife body with a simple operation, like in any of the foregoing embodiments.

In FIG. 9, the configuration of the engagement indentations 23 formed on the wall 22 of the sleeve member of the cutter knife is different from that of the engagement indentations shown in FIG. 5. In the present invention, the configuration of the engagement indentations 23 is not limited to particular one, in so far as the following conditions are satisfied: that is, the sliding out of the blade can be inhibited by the engagement head 72*c* of the spring member 7 coming into contact with the distal end wall 24*a* of the engagement indentation 23, and on the other hand, an escape 24*b* is provided to the proximal end wall of engagement indentation 23, so that the blade can be retracted into the cutter knife body under a predetermined external force directly applied to the blade in the retracting direction.

Next, other embodiments will be illustrated with reference to FIGS. 10 to 14. While the escape is provided to the engagement indentations in the foregoing embodiments, in any of the following embodiments, an escape is provided to the engagement head of a spring member 170. Other structure of the cutter knife is the same as those of the foregoing embodiments.

Figure 10:
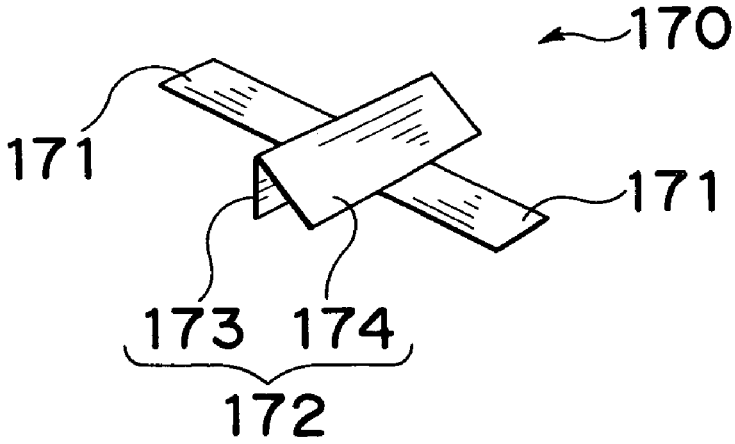
FIG. 10 is a perspective view of a spring member used in another embodiment of the present invention.

FIG. 10 is a perspective view of a spring member 170 which is to be assembled into a slider in the same manner as in the spring member 7 shown in FIG. 2.

The spring member 170 is formed by bending one sheet of metal plate. The spring member 170 comprises a narrower flat spring portion 171 which extends along the advancing or retracting direction of the blade 1, and a convex engagement head 172 wider than the spring portion 171, which is projected from the center of the spring portion 171, and is formed integrally with the spring portion 171. The engagement head 172 comprises an upright wall 173 bent at approximately 90° to the flat spring portion 171, and a sloped wall 174 adjoining to the upright wall 173.

Figure 11:
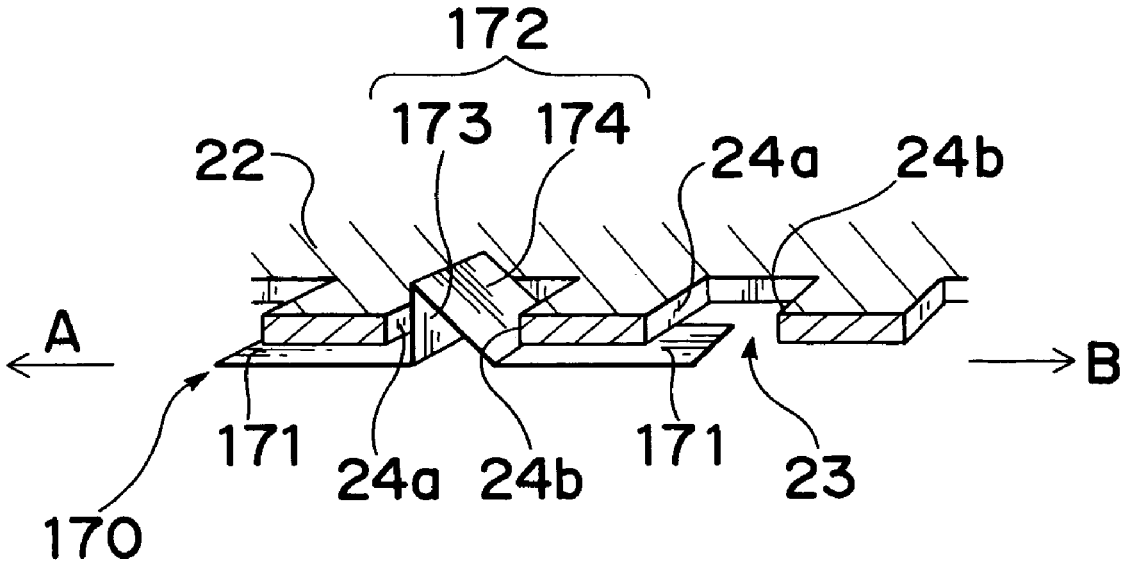
FIG. 11 is a schematic diagram illustrating the principle of the locking mechanism using the spring member shown in FIG. 10.

FIG. 11 shows an explanatory view of main part, wherein the engagement head 172 of the spring member 170 is engaged with one of the engagement indentations 23 formed to the wall 22 of a sleeve member. Note that the spring member 170 in FIG. 11 is of somewhat different configuration from the spring member in FIG. 10, but this is for easy understanding of the principle of the engagement. In fact, the laterally extended portion of the engagement head 172 of the spring member 170 shown in FIG. 10 is engaged with the engagement indentation 23. But, in the present invention, the configuration of the spring member is not limited to such particular one.

Although not shown in FIG. 11, the spring member 170 is connected to the slider body 5, which in turn is connected to the blade 1. Accordingly, when an external force is directly applied to the blade 1 in the advancing direction of the blade, the spring member 170 is pulled in the direction of arrow "A" shown in FIG. 11. On the other hand, when an external force is directly applied to the blade 1 in the retracting direction of the blade, the spring member 170 is pushed in the direction of arrow "B" shown in FIG. 11.

When the spring member 170 is pulled in the direction of arrow "A", the upright wall 173 of the spring member 170 comes into contact with the distal end wall 24*a* of the engagement indentation 23 to thereby inhibit the spring member 170 from moving, and as a result, the blade 1 is inhibited from sliding out. On the other hand, when the spring member 170 is pushed in the direction of arrow "B", the sloped wall 174 comes into contact with the proximal end wall 24*b* of the engagement indentation 23, and the engagement head 172 of the spring member 170 escapes downward in FIG. 11 due to the resilience of the spring, and as a result, the spring member 170 can be moved in the direction of arrow "B". As a result, the blade 1 can be retracted into the cutter knife body. In other words, the sloped wall 174 at the proximal end of the engagement head 172 serves as an escape.

When the slider 3 is operated for sliding out or retracting the blade 1, manipulating the operating member 6 causes that the locking part 63 replaces the engagement head 172 of the spring member 170 outside the engagement indentation 23, like in the foregoing embodiments. Therefore, the locking mechanism does not operate, so that the blade 1 can be slid out of or into the cutter knife body.

Figure 12:
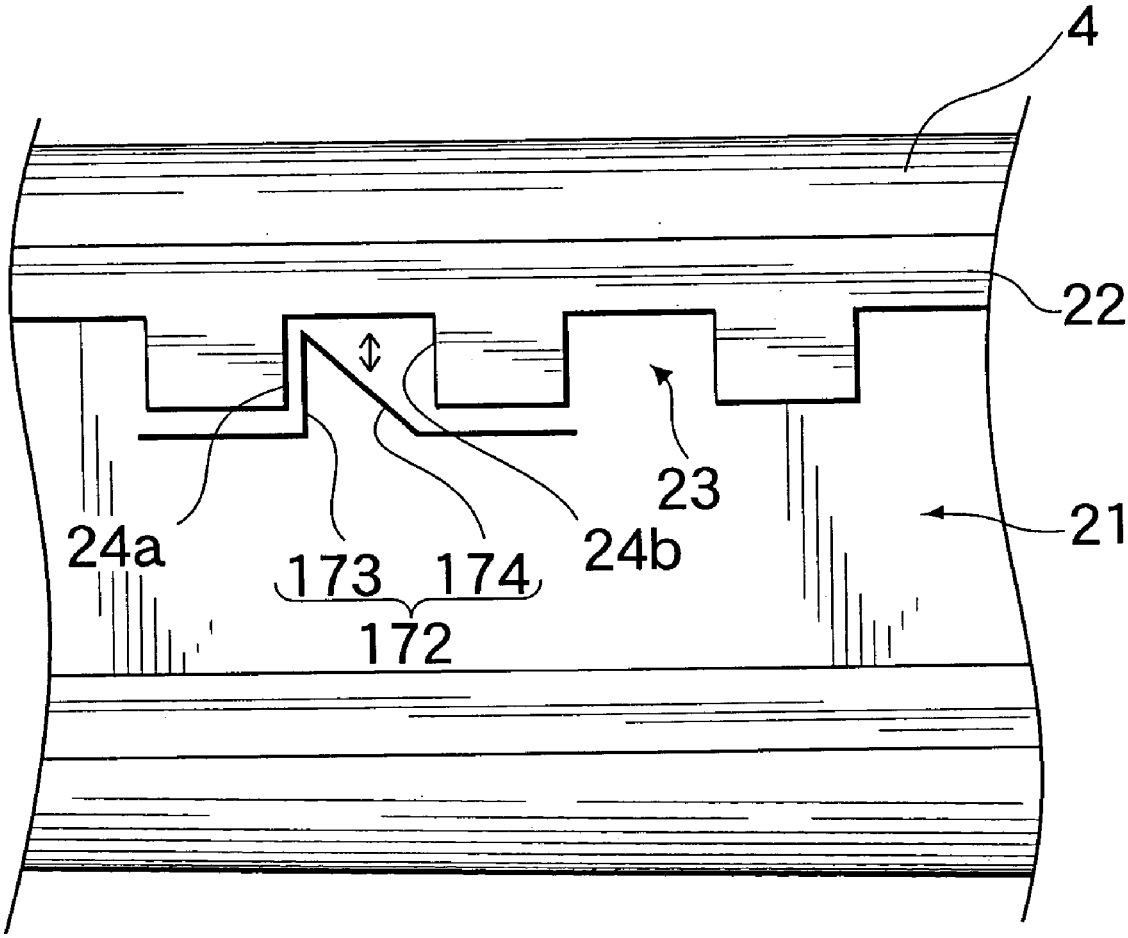
FIG. 12 is an illustrative diagram showing a modification.
Figure 13:
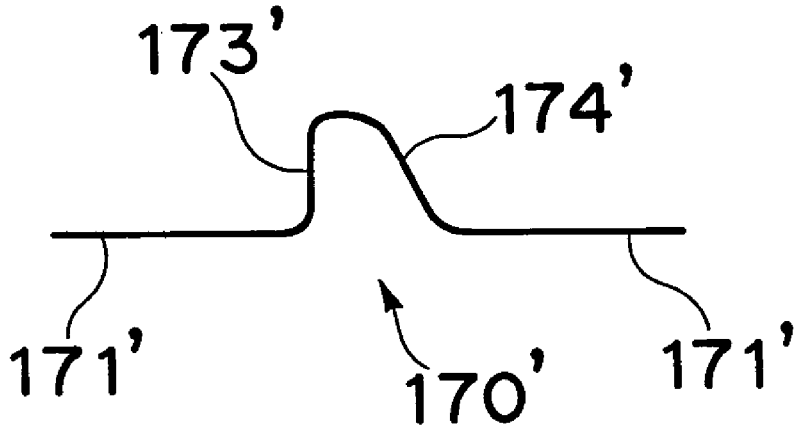
FIG. 13 is a side elevation view of another example of the spring member.

FIG. 12 shows a modification of the above embodiment. The spring member 170 is held, like in the embodiment in FIG. 9, so that the engagement head 172 can be engaged with and disengaged from the engagement indentation 23 in the widthwise direction of the slit 21.

In the case where the escape is provided to the engagement head 172 of the spring member 170, the configuration of the engagement head 172 is not limited to particular ones shown in Figures, and various configurations can be employed. For example, as shown in the side elevation view of FIG. 13, the flat spring portion 171', the upright wall 173' and the sloped wall 174' may be adjoined to one another via curved faces.

Figure 14:
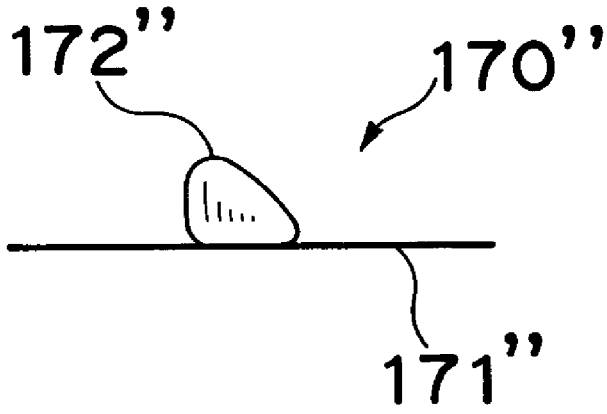
FIG. 14 is a side elevation view of a further example of the spring member.

Otherwise, as shown in the side elevation view of FIG. 14, the flat spring portion 171" and the engagement head 172" of a spring member 170" may be separately formed. In this case, the engagement head 172" may be fixed to the flat spring portion 171" with an adhesive, or otherwise relative position of them may be kept by a separate holding mechanism (not shown) without directly fixing them to each other. The engagement head 172" may be a type of a solid body or a hollow body.

While the preferred embodiments of the present invention have been fully described with reference to the accompanying drawings, it should be noted that various modifications are obvious to those skilled in the art, and it should be construed that such modifications are also included in the scope of the present invention, unless they go beyond the scopes of the appended claims of the present invention.

The invention claimed is:

1. A cutter knife comprising:

an elongated sleeve member having a slit extending along a longitudinal direction, and a plurality of engagement indentations formed at predetermined interval alongside the slit;

a blade slidably held inside the sleeve member; and a slider composed of a slider body which is connected to the blade and is slidable inside the sleeve member, an operating member which is so coupled with the slider body as to shift relative to the slider body and which is exposed to an external through the slit, and a spring member having a convex engagement head, characterized in that the spring member is held between the slider body and the operating member with its engagement head being urged into one of the engagement indentations of the sleeve member, when the operating member of the slider is manipulated to slide the blade, the operating member is shifted relative to the slider body to thereby put the engagement head of the spring member outside the engagement indentation; while when the engagement head is moved to another adjacent engagement indentation, the engagement head is urged into the another adjacent engagement indentation by an urging force of the spring member, when an external force is directly applied to the blade in the advancing direction of the blade, a distal end wall of the engagement indentation contacts with a distal side of the engagement head to inhibit the blade from sliding out, and when a predetermined external force is directly applied to the blade in the retracting direction of the blade, an escape provided to a proximal end wall of the engagement indentation allows the blade to be retracted into the sleeve member.

2. A cutter knife comprising:

an elongated sleeve member having a slit extending along a longitudinal direction, and a plurality of engagement indentations formed at predetermined interval alongside the slit;

a blade slidably held inside the sleeve member; and a slider composed of a slider body which is connected to the blade and is slidable inside the sleeve member, an operating member which is so coupled with the slider body as to shift relative to the slider body and which is exposed to an external through the slit, and a spring member having a convex engagement head, characterized in that the spring member is held between the slider body and the operating member with its engagement head being urged into one of the engagement indentations of the sleeve member, when the operating member of the slider is manipulated to slide the blade, the operating member is shifted relative to the slider body to thereby put the engagement head of the spring member outside the engagement indentation; while when the engagement head is moved to another adjacent engagement indentation, the engagement head is urged into the another adjacent engagement indentation by an urging force of the spring member, when an external force is directly applied to the blade in the advancing direction of the blade, a distal end wall of the engagement indentation contacts with a distal side of the engagement head to inhibit the blade from sliding out, and when a predetermined external force is directly applied to the blade in the retracting direction of the blade, an escape provided to a proximal side of the engagement head allows the blade to be retracted into the sleeve member.

* * * * *